US005735378A

United States Patent [19]

Sundquist

[11] Patent Number: 5,735,378

[45] Date of Patent: Apr. 7, 1998

[54] ROLLER HOLD DOWN DEVICE FOR FOUR-SIDED TAPERED CARTONS

[75] Inventor: Matthew V. Sundquist, Brainerd, Minn.

[73] Assignee: Riverwood International Corporation, Atlanta, Ga.

[21] Appl. No.: 773,165

[22] Filed: Dec. 24, 1996

[51] Int. Cl.[6] ..... B65G 13/00

[52] U.S. Cl. ..... 193/356; 53/387.2; 198/836.3

[58] Field of Search ..... 198/836.1, 836.2, 198/836.3; 193/35 L; 53/251, 387.1, 387.2

[56] References Cited

U.S. PATENT DOCUMENTS

| | | | |
|---|---|---|---|
| 3,000,163 | 9/1961 | Bellamy, Jr. | 53/387.2 X |
| 5,454,776 | 10/1995 | Ulrich et al. | 53/387.2 X |
| 5,531,056 | 7/1996 | Liang | 53/387.2 X |

*Primary Examiner*—James R. Bidwell
*Attorney, Agent, or Firm*—Isaf, Vaughan & Kerr

[57] ABSTRACT

A carton flap hold down apparatus (25) for use in seating an open-ended sleeve-type carton (40) on a carton transport conveyor (27) is disclosed. The carton flap hold down apparatus has a plurality of aligned carton flap hold down rollers (61) disposed along a common longitudinal axis and extending in the direction of a path of travel, each support roller being supported for rotation on an elongate roller support bar (65). A mounting block (67) is fastened on a framework of the carton transport conveyor with respect to a carton flap score rail (31) thereof, the mounting block being spaced from the roller support bar, and an elongate intermediate member (66) is fastened to one end of the mounting block, and fastened at the other of its ends to the roller support bar. The rollers are inclined toward the mounting block in the direction of the path of travel at an angle of 5° for holding, and pulling, the bottom flaps of the carton downwardly against the carton flap score rail to ensure that the carton remains fully seated on the carton transport conveyor as articles are transferred therein from an article selector device. The intermediate member is constructed and arranged to urge the roller support bar toward the carton flap score rail so that each one of the rollers is yieldably engaged on the carton flap score rail for slidably holding the bottom flap of the cartons thereon as the cartons advance along the path of travel.

26 Claims, 5 Drawing Sheets

ROLLER HOLD DOWN DEVICE FOR FOUR-SIDED TAPERED CARTONS

FIELD OF THE INVENTION

This invention relates in general to packaging machines for forming articles into groups of articles of a predetermined number, and directing the groups of articles toward and into open containers, such as pre-formed paperboard cartons, moving along a path of travel on a continuous motion packaging machine. More particularly, the invention relates to a roller hold down device for engaging the bottom flap, or flaps, of open ended sleeve-type paperboard cartons for seating the bottom panel of the cartons on the carton transport conveyor.

BACKGROUND OF THE INVENTION

Continuous motion packaging machines are known in the art. A common type of continuous motion packaging machine is an end loading machine which selects a predetermined number of articles, for example beverage containers, and more particularly bottles and cans, forms the articles into a desired product group size or configuration, for example six-packs, twelve-packs and full case lots of 24 article containers, and then passes the articles into a unitary container such as a pre-formed paperboard carton. Various product or article group sizes or configurations may therefore be packaged on the same packaging machine, depending on the desired packaging configuration of the articles, and the size of the article container or carton. A selector device is typically used to group the articles and move them as a group toward and through the open end, or ends, of a pre-formed sleeve-type paperboard carton. Thereafter, the flaps at the open end, or ends, of the carton will have glue applied thereto at a glue application station, the flaps will be folded into a closed position on the end, or ends, of the carton, and sealed thereon as the carton is passed downstream and along the path of travel for further processing and/or shipment.

The pre-formed paperboard cartons are generally supplied as substantially flat and pre-scored carton blanks held in a carton magazine. The carton blanks are sequentially drawn from the magazine by a picker device adapted to select a carton blank, erect the carton blank, and place the empty and erected carton on a carton transport conveyor moving in the direction of the path of travel. The carton transport conveyor will typically be provided with a series of spaced and upstanding lugs along its length for forming a series of carton transport flights, or pockets, which will move a sequential and spaced series of empty and erected cartons in concert with the formation of groups of articles by the packaging machine selector device, the selector device passing the pre-formed groups of articles through the open end, or ends, of the cartons and into the cartons in the above-described fashion.

After the empty erected cartons have been placed within the flights of the carton transport conveyor, the cartons are moved toward a guide, also known in the industry as a plow, adapted to engage and fold the bottom flap, or flaps, at the open end, or ends, respectively, of the cartons downwardly with respect to the bottom panel of the carton blank so that as the pre-formed group of articles is passed from the article selector device into the cartons, the articles are not encumbered by the bottom flap, or flaps, in any way, nor is the bottom flap damaged by the articles as they are passed into the container. Moreover, by folding the bottom flap, or flaps downwardly, it is hoped that a smooth transfer of the articles from the selector device into the carton may occur and that a "step up" is avoided in which the bottom panel of the carton will be situated higher than the bottom horizontal plane on which the articles are resting, typically on a moving conveyor belt formed as a part of the selector device.

One problem that has arisen with the use of sleeve-type cartons on continuous motion packaging machines, and in particular during high speed packaging operations, is that the upper portion of the empty erected cartons being conveyed within the flights of the carton transport conveyor tend to drag or lag behind the bottom portions held in place by the upstanding pusher lugs of the carton transport conveyor, which can cause the cartons to become skewed or deformed as they move along the path of travel. This results in a situation where the articles cannot be transferred smoothly, nor quickly, into the cartons due to misalignment of the cartons with the selector device, primarily due to carton step-up, thus either damaging the carton, or resulting in the packaging of an incomplete group of articles, or in jamming or bridging across the article selector device so that an interruption of the packaging flow results, all of which requires machine shut down resulting in decreased packaging performance and increased packaging costs. Moreover, this problem becomes more pronounced the taller the carton becomes relative to the width of the flight or pocket in which the carton is placed, i.e., the carton width itself, as the carton will tend to move out of square and lift off of the conveyor more so than with a "shorter" container.

To combat this problem, therefore, many packaging machines are provided with an overhead hold down device used to support and brace the top portion of the cartons as they move along the path of travel. One example of such an overhead hold down device is disclosed in the Article Packaging Machine With Improved Overhead Flight Assembly described in patent application No. 08/660,432 filed in the United States Patent and Trademark Office on Jun. 7, 1996. While such overhead hold down devices vary in construction and operation, in general they comprise an endless flexible conveyor, such as a chain or a belt, having a lower flight positioned above the tops of the cartons, and supplied with a spaced series of downwardly projecting pusher lugs, each overhead pusher lug being aligned with a respective one of the pusher lugs on the carton transport conveyor, so that the carton is held therebetween and moved along the path of travel with the side panels of the carton remaining substantially vertical in order to minimize the skewing of the cartons. This in turn allows the pre-formed groups of articles to be slidably moved through the open end, or ends, of the cartons with minimal damage to the cartons, thus improving machine efficiency and packaging speed.

The use of these overhead hold down devices, however, requires the delicate balancing of holding the empty cartons in position within the respective flights of the carton transport conveyor so that the side panels thereof remain substantially vertical, without pressing down so hard as to deform the sides of the carton by bowing the sides out, thus again leading to skewing of the cartons, and the problems that result therefrom, to include lipping and carton step-up. If, however, the overhead hold down device is not set properly so that the bottom panel of the empty carton is not fully seated on the carton transport conveyor, a step up or lip may still be present at the bottom edge of the panel adjacent the conveyor belt of the article selector device. Rather than pulling the bottom panel down flat onto the article transport conveyor, overhead hold down devices push the top panel of the carton down in the hope that the bottom panel of the carton will be fully seated on the carton transport conveyor.

Moreover, overhead hold down devices make it difficult to remove damaged cartons during packaging operations, i.e. the machine has to be stopped, the hold down device has to be lifted, the package has to lifted and removed from the carton transport conveyor, the hold down device is then lowered and positioned once again so that it does not crush the cartons, yet holds them down firmly on the carton transport conveyor, whereupon packaging operations may be resumed. Another problem which arises from the use of overhead hold down devices is that they may not provide the needed flexibility in handling cartons of a wide variety of sizes, nor allow for quick product size or article grouping changeovers demanded in high speed continuous motion packaging operations, in which one continuous motion packaging machine is oftentimes equipped to package articles of a variety of article sizes, as well as in a variety of packaging configurations. Each time the carton size is changed over, this same delicate balancing of the positioning of the overhead hold down device with respect to the carton transport conveyor, and of securely holding the cartons within the flights without deforming the cartons, while also trying to prevent the step-up or lipping of the carton occurs.

What is needed, therefore, but seemingly unavailable in the art is a simple device which will hold the bottom panels of empty erected sleeve-type cartons on a carton transport conveyor so that the step up or lip of the bottom panel of the carton with respect to the article selector device is avoided, thus allowing for efficient high speed packaging operations. What is also needed, but apparently unavailable in the art, is a simple low cost device which can accomplish this task without requiring a great deal of time in machine adjustment prior to use so that quick product changeovers, and thus machine flexibility, can be maintained for realizing greater packaging machine efficiencies. What is also needed is a simple device which will accomplish these tasks but yet is adapted for use with a wide variety of articles, packaging configurations, and carton sizes, and is adjustable for handling paperboard cartons of different wall thicknesses and surface finish to ensure that the cartons remain seated on the carton transport conveyor, and which is also adapted for the quick removal of damaged cartons when, and if, a carton becomes damaged during packaging operations. Moreover, what is needed but unavailable in the art is a simple and efficient hold down device for securely seating the bottom panels of empty, erected sleeve-type cartons on a carton transport conveyor which will satisfy the demands for flexibility, and high production rates present in the use of continuous motion packaging machines in high volume packaging operations.

SUMMARY OF THE INVENTION

The present invention provides an improved hold down device for use on continuous motion packaging machines which overcomes some of the design deficiencies of other hold down devices known in the art. The roller hold down device of this invention provides a simple, efficient, and highly flexible apparatus for seating the bottom panels of empty, erected, sleeve-type cartons within the flights of a carton transport conveyor that minimizes the lipping, or step up of the bottom panel of the carton with respect to the article selector device so that the smooth and unimpeded transfer of groups of articles may be accomplished in high speed packaging operations while minimizing the prospects of damaging the cartons, and/or jamming the packaging machine during the transfer of the articles into the carton. The relative simplicity of this device in comparison with the known hold down devices allows for a higher degree of flexibility in use in that it is readily adapted for cartons of any size without requiring that the packaging machine be stopped and the hold down device re-positioned with respect to the carton transport conveyor for the type of carton being moved thereon, thus allowing for improved packaging machine efficiencies.

This invention attains this high degree of flexibility while maintaining simplicity in design and operation by providing a carton flap hold down apparatus for use in seating sleeve-type cartons on a carton transport conveyor as the cartons are carried in the flights of the conveyor and along a path of travel by holding the bottom flap, or flaps, of the carton against a carton flap score rail, or rails, formed as a part of the carton transport conveyor, and supported on the framework of the packaging machine. Once the bottom flap, or flaps, of the carton have been folded against the respective carton rail or rails of the carton transport conveyor by a conventional guide, plow, or knock down device, the flap is engaged by a plurality of aligned carton flap hold down rollers disposed along a common longitudinal axis extending in the direction of the path of travel. Each roller is supported for rotation on an elongate roller support bar in the direction of the path of travel. A mounting block formed as a part of the apparatus is fastened to the framework of the carton transport conveyor with respect to the carton flap score rail, and is spaced from the roller support bar. An elongate intermediate member is fastened at one of its ends to the mounting block, and fastened at the other of its ends to the roller support bar to hold the roller support bar in position with respect to the carton flap score rail.

The longitudinal axis of the carton flap hold down rollers is inclined in the direction of the path of travel at an angle of approximately 5° from horizontal so that the hold down rollers pull the bottom flaps of the carton downwardly and against the carton flap score rail to ensure that the bottom panel of the carton is seated on the carton transport conveyor, thus minimizing any lipping or step up of the bottom panel of the carton with respect to the article selector device for allowing the smooth and unimpeded transfer of article groups into the cartons being moved along the carton transport conveyor. The intermediate member of the carton flap hold down apparatus comprises a spring assembly for urging the roller support bar toward the carton flap score rail so that each of the rollers or the roller hold down device is yieldably engaged on the carton flap score rail for slidably holding the bottom flaps of the cartons thereon as the cartons advance along the path of travel. The spring assembly may comprise either a compression spring assembly, or alternately a leaf spring assembly.

The roller hold down device of this invention may be provided in a spaced series of roller hold down devices along at least a portion of the length of the carton transport conveyor and extending along the path of travel. If desired, a second identical series of roller hold down devices may be positioned on the opposite side of the carton transport conveyor so that two spaced series of roller hold down devices, in substantial registry with one another, are positioned on opposite sides of the carton transport conveyor and extend along at least a portion of the length thereof for holding the spaced bottom flaps of the cartons against the carton flap score rails to seat the respective bottom panels of the cartons on the carton transport conveyor.

The unique and novel structure of this invention thus provides a simple, yet highly efficient means for seating empty, erected, sleeve-type cartons on a carton transport conveyor without the need to include an overhead hold down device of the type known in the art while allowing for greater flexibility in packaging operations, greater ease of maintenance, greater ease of use, and at a greatly reduced cost with respect to the cost of the overhead hold down devices known in the art. Moreover, the novel apparatus of this invention allows for a high degree of flexibility in packaging machine operations, is less likely to lead to the damaging of the cartons as they are being filled with the article groups, is less likely to result in jamming of the article selector/feed device of the packaging machine, and will thus allow for greater production rates than heretofore known in the art. Accordingly, the objects of the present invention include the ability to hold the bottom flaps of sleeve-type cartons down for seating the bottom panels of the cartons on a carton transport conveyor in a highly simple and efficient manner to allow for greater degree of flexibility in packaging operations than heretofore known in the art. The present invention accomplishes the above-stated objects while providing for flexible, efficient, and continuous high speed article packaging operations.

DETAILED DESCRIPTION OF THE PREFERRED EMBODIMENT

Figure 1:
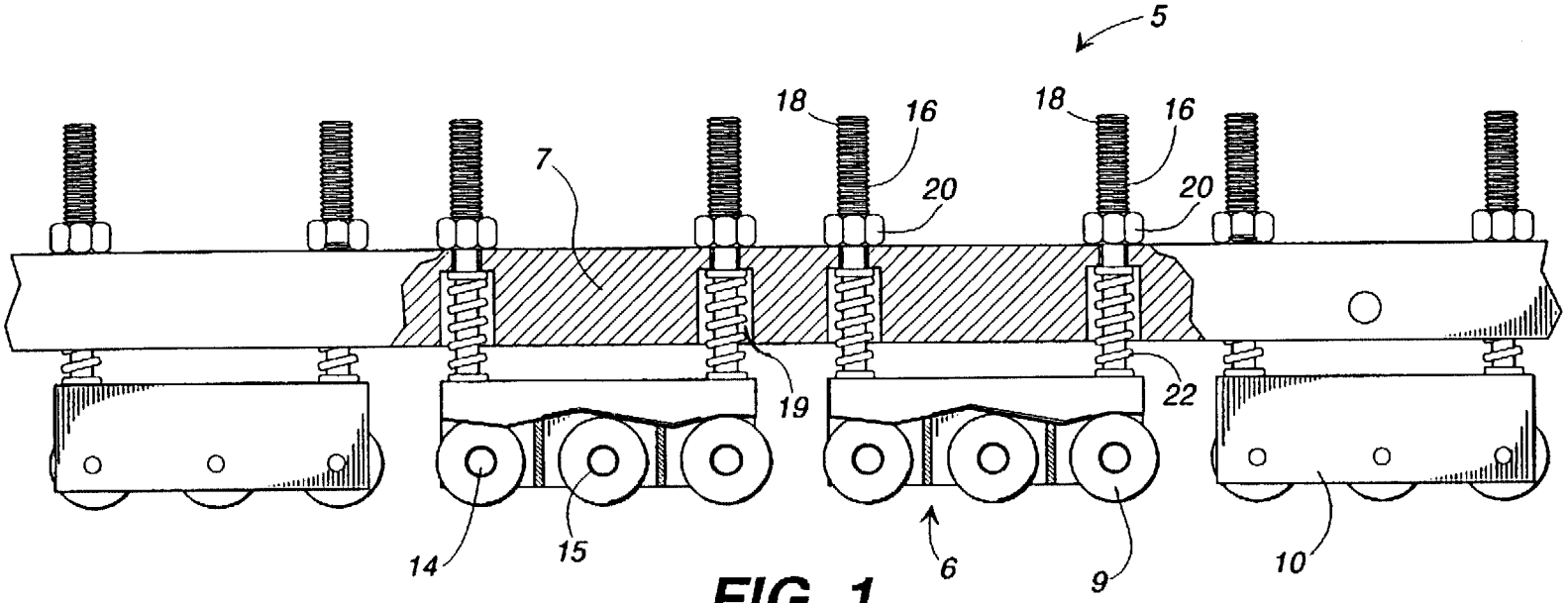
FIG. 1 is a top plan view of a prior art roller device used to grasp the handles of basket-type article carriers.
Figure 2:
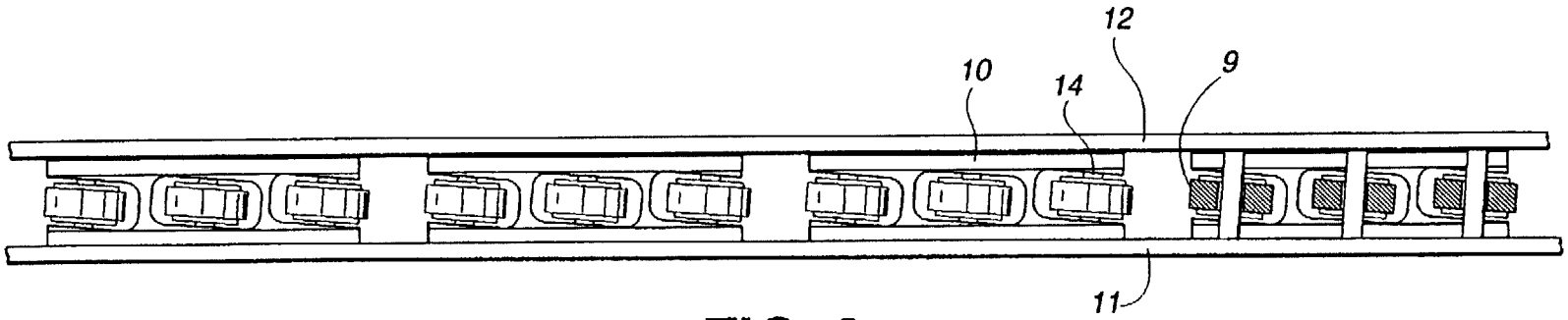
FIG. 2 is a side elevational view of the prior art device of FIG. 1.

Referring now to the drawings, in which like reference characters indicate like parts throughout the several views, a handle guide device 5 is illustrated in FIGS. 1 and 2. Handle guide device 5 is an apparatus known as the Rough Rider manufactured by Riverwood International, Inc., and is used in conjunction with basket-type article carriers used, for example, to carry six-packs of beer bottles and the like. Handle guide device 5 includes a spaced series of roller assemblies 6, each secured on an elongate mounting bar 7. Each roller assembly 6 has a plurality, in this instance, three, rollers 9. Each of rollers 9 is held within an aluminum housing 10, the aluminum housing being machined, as illustrated generally in FIG. 2, to receive each one of the rollers therein. Each of aluminum housings 10 is secured to mounting bar 7 by being sandwiched between a bottom plate 11 and a top plate 12, these two plates typically being constructed of steel.

Each of rollers 9 is supported on a pin shaft 14 and is supported for rotation on the pin shaft by a bushing 15. A pair of spaced rods 16 protrude from each of housings 10, the proximal end of each rod being fastened to the housing, and the distal end of each rod having a thread 18 formed thereon. The distal end of each rod is passed through one of a series of spaced smooth bores 19 machined within mounting bar 7. Prior to passing each one of rods 16 through a smooth bores 19 however, a spring 22 is passed over the rod, and is secured in position between housing 10 and mounting bar 7 on each one of the respective rods. As best shown in FIG. 1, a threaded nut 20 is received on the thread 18 on the distal end of each one of rods 16, and is used to draw the rod toward mounting bar 7 for compressing spring 22, thus spring loading each one of roller assemblies 6, and thus each of rollers 9, respectively.

As shown in FIG. 2, each one of rollers 9 is inclined with respect to horizontal, i.e. bottom plate 11 and top plate 12, by being inclined in the direction of the path of travel of the handle (not illustrated) of a basket-type carrier (not illustrated) being withdrawn from a carton magazine (not illustrated) of a continuous motion packaging machine (not illustrated). Although each of rollers 9 is inclined with respect to plates 11 and 12, respectively, as shown in FIG. 2, the pin shafts or each of rollers 9 are otherwise parallel to one another.

To adjust handle guide device 5 in position relative to the path of travel (not illustrated) of the carton handles (not illustrated) being passed thereby, mounting bar 7 is moved in its entirety toward and away from the path of travel so that rollers 9 will engage the carton basket handle (not illustrated) in the desired fashion. Each one of individual roller assemblies 6 is not adjusted, as the compression force of springs 22 has been preset for the particular basket-type carton being handled, and it is not otherwise desired, nor intended, to move the roller assemblies individually with respect to the carton basket path of travel.

Handle guide device 5 is used by grasping the handle (not illustrated) between each of rollers 9 and a dead plate (not illustrated) to locate or positively control the handle with respect to the remainder of the carton blank (not illustrated) yet to be opened into the basket-type carton by a suction cup carton opening device, or other similar opening device known in the art. Handle guide device 5 is not well suited for controlling the flaps of open-ended sleeve-type cartons, such as carton 40 shown in FIGS. 3 and 4, in that the entire apparatus is too bulky, and is not well suited to the requirements of individually tailoring each one of roller assemblies 6 for use with a variety of cartons 40 necessitated by the quick changeover of carton sizes on high speed continuous motion packaging machines. Moreover, handle guide device 5 has the drawback of being extremely cost prohibitive in that each one of housings 10 is a block of machined aluminum receiving rollers 9 therein, with a pin 14 being secured to the roller housing and to bottom plate 11 and top plate 12, all this in turn being secured to mounting bar 7 to form the device. As shown in FIGS. 1 and 2, this requires a great deal of machining of mounting bar 7 and of housings 10, each of which are made of aluminum, as well as the precise alignment of bottom plate 11 with top plate 12 with respect to mounting bar 7 and housings 10, and particularly of pin shafts 14 therebetween, to construct the handle guide device.

Figure 3:
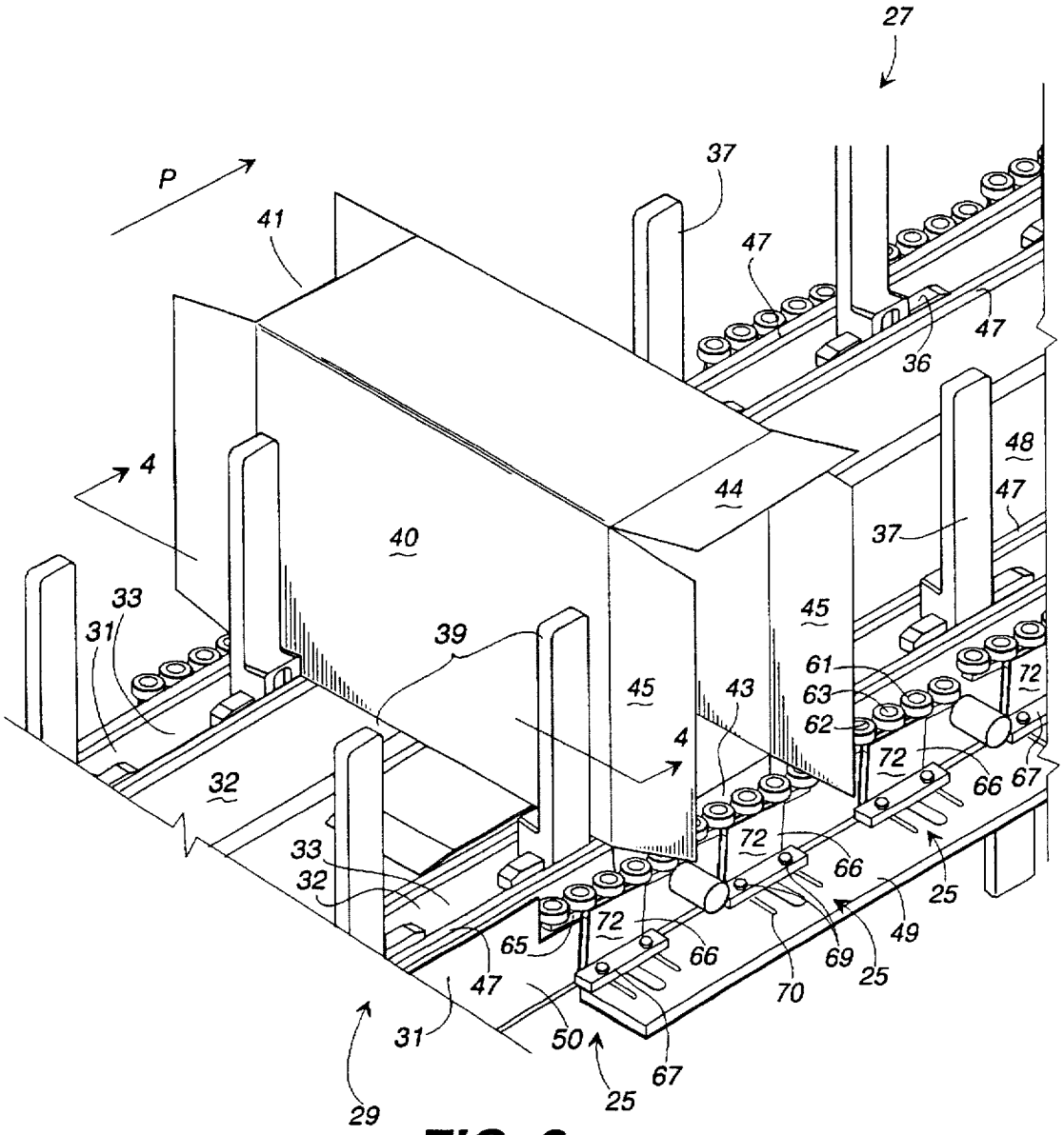
FIG. 3 is a perspective view of a first embodiment of the roller hold down device of this invention in use on a carton transport conveyor of a continuous motion packaging machine.
Figure 4:
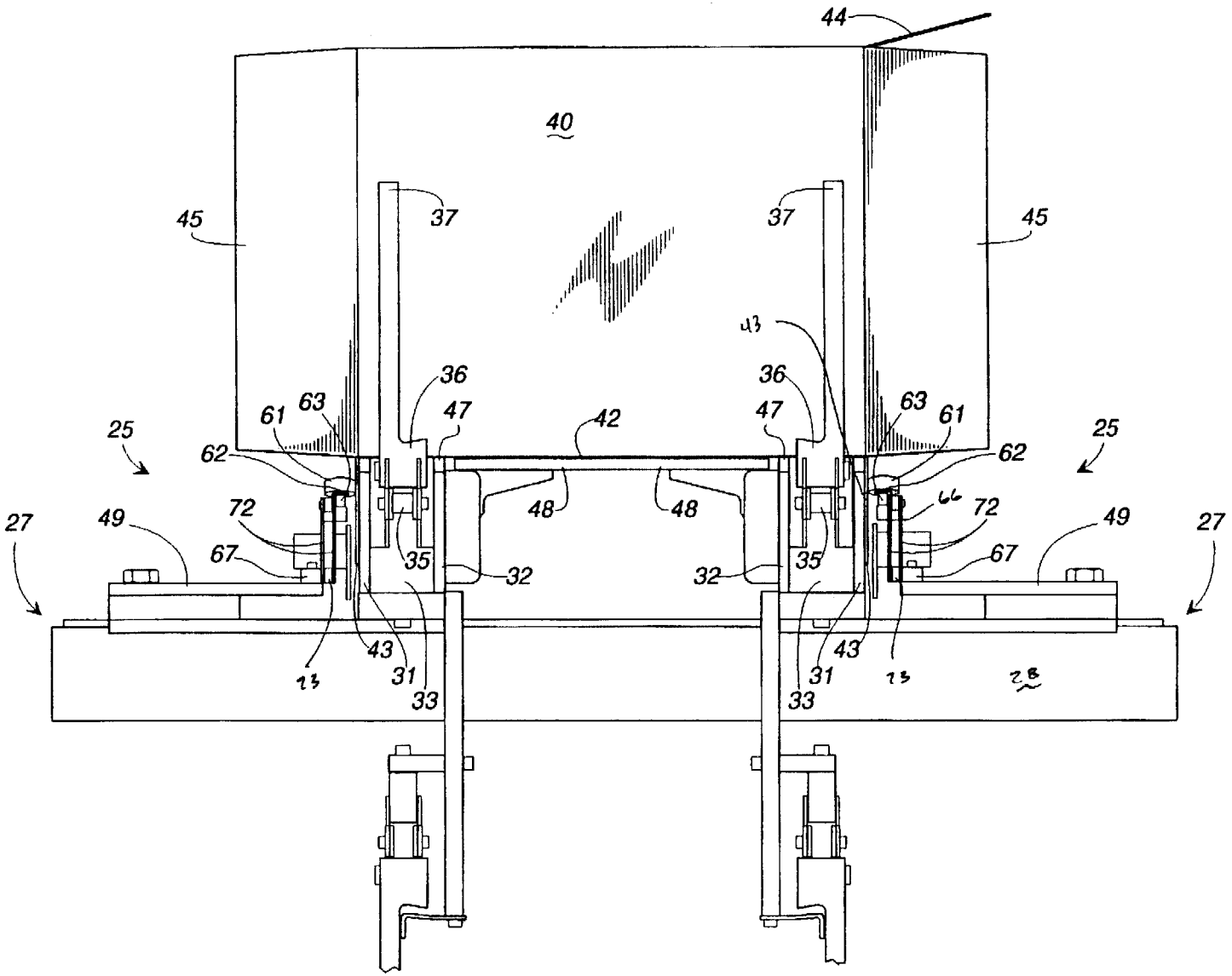
FIG. 4 is an end elevational view along line 4—4 of FIG. 3.

The improved roller hold down device of this invention is illustrated in FIGS. 3–7. Referring first to FIG. 3, a spaced series of roller hold down devices 25 is illustrated extending along at least a portion of the length of both sides of a carton transport conveyor 27. Carton transport conveyor 27, as illustrated in FIGS. 3 and 4, has a framework 28 supporting a pair of spaced and parallel rail assemblies 29. Each rail assembly 29 includes an outside carton flap score rail 31, and a spaced parallel inside rail 32. A channel 33 is formed intermediate each pair of rails 31, 32.

As best shown in FIG. 4, an endless conveyor chain 35 is received within each channel 33. Conveyor chains 35 are driven by conventional means so that they continuously move in the direction of a path of travel, designated by the notation "P" in FIG. 3. A spaced series of lug bases 36 (FIG. 3) are attached to each conveyor chain 35, each lug base 36 having a lug 37 protruding upwardly therefrom. As shown in FIG. 3, the lugs are disposed in spaced parallel pairs on each one of conveyor chains 35 for each one of rail assemblies 29, thus forming a spaced series of flights 39 along the entirety of the length of carton transport conveyor 27.

An empty, erected open-ended sleeve-type carton 40 is shown received within one of these flights 39 in FIG. 3. Canon 40 has a pair of spaced open ends 41, and substantially flat planar bottom panel 42 oriented in a horizontal position on wear strips 47 of carton transport conveyor 27. Each end of cartons 40 includes a pair of bottom flaps 43 hingedly connected thereto, a pair of spaced top flaps 44 hingedly connected thereto, and a pair of generally vertical side flaps 45 also hingedly connected thereto. In known fashion, each of flaps 43, 44, and 45 can be folded toward the other along pre-formed score lines, with glue applied thereto, and sealed in closed position on one another with bottom flap 43 and top flap 44 being received on the exterior of side flaps 45.

As shown in FIGS. 3 and 4, each one of rail assemblies 29, and in particular rails 31 and 32, includes an elongate continuous wear strip 47, typically formed of an engineering polymer and mounted on the top edge of each rail for forming a smooth transport surface for the bottom panel 42 of carton 40 as it is slid thereon. As also shown in FIG. 3, a substantially planar dead plate 48 is shown intermediate rail assemblies 29 for providing a load bearing surface to support carton 40, and particularly bottom panel 42 thereof, as the group of articles is moved into the carton. As also shown in FIG. 3, each of roller hold down devices 25 is positioned on an elongate base plate 49 positioned adjacent the carton flap score rail of each rail assembly 29. Positioned upstream of roller hold down devices 25, is a guide, or plow, 50 positioned with respect to each of the rail assemblies so that bottom flaps 43 are received therein after being knocked down by a knock-down device, as known to those skilled in the art, for guiding the flaps in a downwardly folded position intermediate carton flap score rails 31 and guides 50 as the carton progresses along the path of travel, and as bottom flaps 43 thereof are moved toward roller hold down devices 25.

Roller hold down devices 25 extend along that portion of the length of carton transport conveyor 27 during which the articles (not illustrated) are transferred from selector device 53 (FIG. 7) through the open end 41 of carton 40 so that each of bottom flaps 43 is pulled downwardly to firmly seat bottom panel 42 on wear strips 47, thus ensuring that no lip or step-up between bottom panel 42 and the surface of a conveyor belt 55 (FIG. 7) of selector device 53 (FIG. 7) is present which would otherwise act as an impediment to the smooth and rapid transfer of the articles from the selector device into the carton. Roller hold down devices 25 will thus extend along the length of carton transport conveyor 27 from a point shortly before that at which the transfer of the articles into carton 40 begins, to a point shortly beyond that at which all of the articles are transferred into the carton, whereupon the roller hold down devices will release bottom flap 43 prior to the carton reaching a glue application station (not illustrated), whereupon the flaps will be glued, and sealed upon one another in known fashion.

Figure 5:
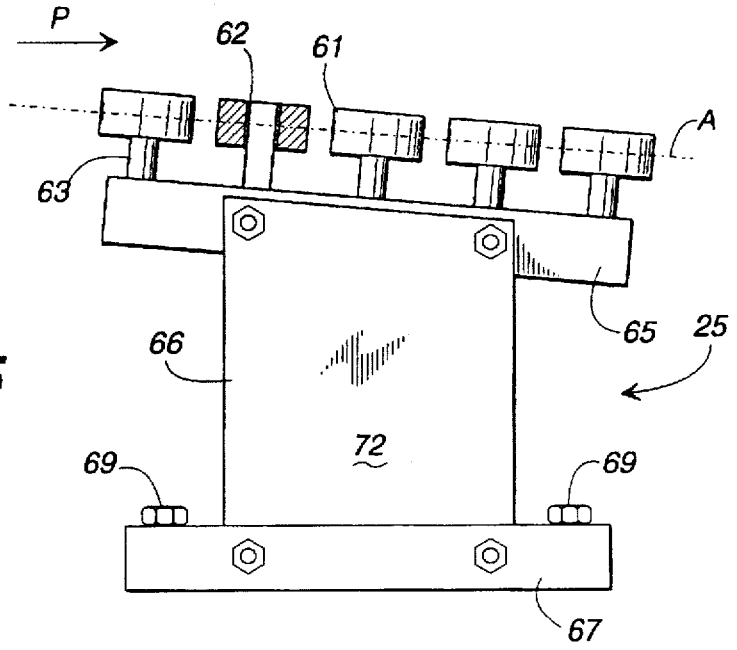
FIG. 5 is a side elevational view of the embodiment of the roller hold down device illustrated in FIGS. 3 and 4.

Referring now to FIGS. 4 and 5, a first embodiment of roller hold down device 25 is illustrated. As shown generally in FIG. 3, and more specifically in FIGS. 4 and 5, the first embodiment of roller hold down device 25 includes a spaced series of rollers 61, in this instance five, positioned along a common longitudinal axis denoted by the reference character "A". Each roller 61 is supported for rotation on an elongate roller support bar 65, and has a bearing assembly 62 formed centrally as a part thereof, received on an elongate pin shaft 63 projecting from roller support bar 65. Thus, and as shown in FIGS. 3 and 5, each of rollers 61 extends in alignment with one another along longitudinal axis A.

As best shown in FIGS. 3–5, an elongate intermediate member 66 extends from roller support bar 65 to a mounting block 67 so that one end of intermediate member 66 is fastened on roller support bar 65, the other end being fastened to mounting block 67. Mounting block 67 is in turn fastened to one of base plates 49, base plate 49 in turn being fastened to framework 28 of carton transport conveyor 27 to thus position roller hold down device 25 with respect to the respective ones of carton flap score rails 31, as best shown in FIGS. 3 and 4. Each one of mounting blocks 67 is held on base plate 49 by a pair of spaced fasteners 69, for example a threaded bolt and a nut, received within a pair of slots 70 defined within the base plate, so that mounting block 67, and thus roller hold down device 25 can be moved laterally toward and away from the respective ones of carton flap score rails 31 to thus decrease and increase, respectively, the gap between the peripheral surface of each of rollers 61 and the exterior surface of carton flap score rails 31 and through which each one of bottom flaps 43 is passed. Each of roller hold down devices 25 is positioned on base plate 48 so that bottom flap 43 is engaged by rollers 61 for holding bottom flap 43 slidably against the carton flap score rails, while also pulling the bottom flap 43 of the carton downwardly thus ensuring that bottom panel 42 of carton 40 remains firmly seated on wear strips 47 of carton transport conveyor rail assemblies 29.

The first embodiment of roller hold down device 25 illustrated in FIGS. 3 and 4 is illustrated in more detail in FIG. 4. In this embodiment of roller hold down device 25 intermediate member 66 is a leaf spring assembly. Thus, and as shown in FIGS. 3–5, a pair of parallel and spaced leaf springs 72 extends from mounting block 67 to roller support bar 65. A spacer 73 is received between the bottom end of each leaf spring 72 and is fastened thereto, the spacer in turn being fastened to mounting block 67. The upper end of each of the leaf springs are positioned on opposite exterior sides of roller support bar 65, the support bar being received intermediate the two leaf springs so that the leaf springs are secured in position with respect to one another. Each one of leaf springs 72 is formed of a piece of spring steel, and is less than 1/32 of an inch thick in order to retain the proper degree of spring resiliency with respect to the otherwise structural rigidity of using a steel sheet. As an alternative, leaf spring 72 could be constructed of a flexible engineering polymer, for example a plastic, so that the requisite degree of spring resiliency is obtained.

Each one of roller support bars 65 is urged by intermediate member 66 toward the carton flap score rail so that rollers 61 are yieldably engaged with the exterior of carton flap score rail 31, thus allowing bottom flap 43 to be slidably passed between each of rollers 61 against carton flap score rails 31, while also providing sufficient lateral force through the use of the spring, i.e. intermediate member 66, to exert a pulling force downward on the bottom flap in conjunction with the inclination of roller support bar 65 as the carton moves along the path of travel.

Figure 6:
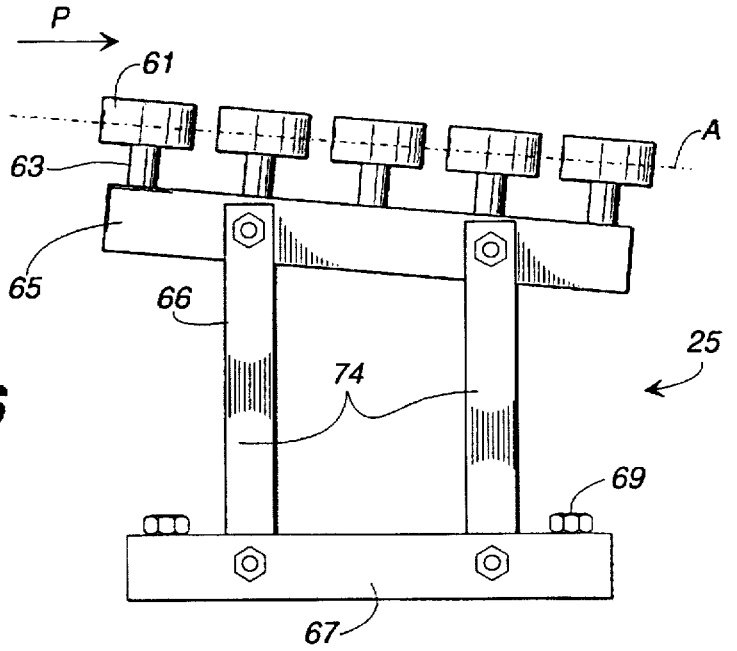
FIG. 6 is a side elevational view of an alternate embodiment of the roller hold down device of FIGS. 3 and 4.
Figure 7:
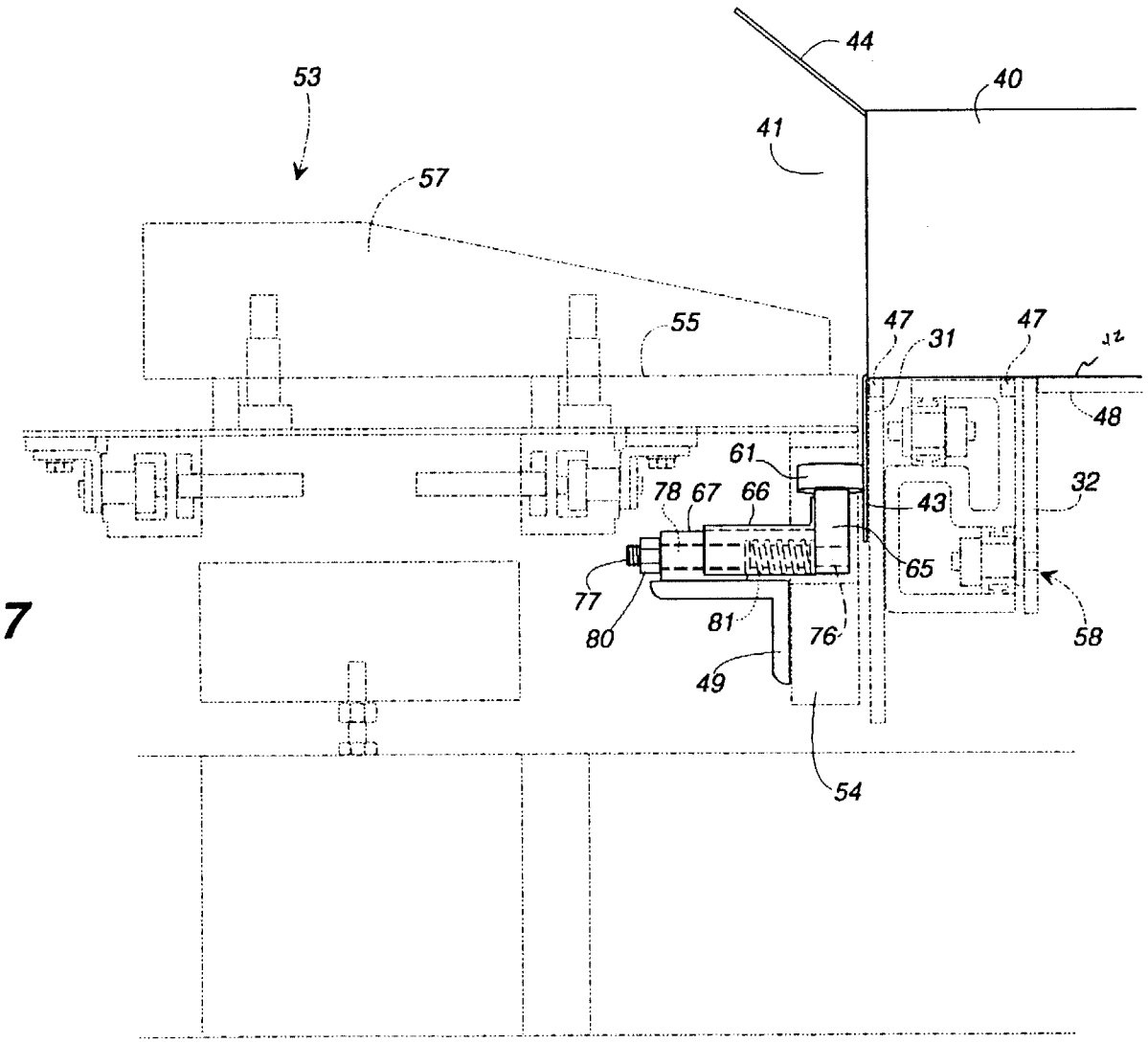
FIG. 7 is an end elevational view, partially in cross-section, of a third embodiment of the roller hold down roller device in use on a continuous motion packaging machine.

As shown in FIG. 5, and also shown in FIG. 6 for an alternate embodiment of roller hold down device 25, each of rollers 61 is inclined from horizontal at an angle of 5° downwardly in the direction of the path of travel so that bottom flap 43 is grasped and progressively pulled downwardly to maintain tension on the bottom flap, thus ensuring that the bottom panel remains seated on wear strips 47 as carton 40 is moved within one of flights 39 along the path of travel toward, and adjacent, selector device 53 (FIG. 7). As shown in FIG. 5, each of leaf springs 72 is conventionally fastened to mounting block 67, spacer 73, and roller support bar 65 by threaded fasteners (not illustrated) or other conventional fasteners. If so desired, leaf spring 72 could be welded or soldered, or otherwise glued, to mounting block 67, spacer 73, and roller support bar 65.

An alternate embodiment of roller hold down device 25 is illustrated in FIG. 6, in which two pairs of spaced and parallel leaf springs 74 are used rather than just a single pair of spaced leaf springs 72. Otherwise, the embodiment of roller hold down device 25 illustrated in FIG. 6 is constructed identically to that in FIG. 5, namely each of rollers 61 is inclined 5° from horizontal along a common longitudinal axis A, and each pair of leaf springs 74 is mounted to a spacer 73, spacer 73 in turn being fastened to mounting block 67 at one end, and fastened on opposite sides of roller support bar 65 at their other end, the support bar being positioned intermediate the two pairs of leaf springs, to form a unitary roller hold down device 25. As with the embodiment of FIG. 5, the embodiment of roller hold down device 25 illustrated in FIG. 6 uses steel as leaf springs 74, the steel being less than 1/32 of an inch thick in order to obtain the proper degree of spring resiliency with respect to the bending stiffness of the steel in the leaf spring otherwise. Also, and if so desired, leaf springs 74, as well as leaf springs 72, could be constructed of an engineering polymer or any similar rigid, yet flexible material suitable for use as a leaf spring. Examples of these types of materials might be carbon filament compositions, fiberglass, engineering polymers (plastics), and other similar materials.

A third embodiment of roller hold down device 25 is illustrated in FIG. 7. The embodiment of roller hold down device 25 illustrated in FIG. 7 uses a compression spring 81 rather than leaf springs 72 as a part of intermediate member 66. Roller hold down device 25 is illustrated in FIG. 7 as being positioned on a base plate 49 fastened to a common framework 54 of a selector device 53 and a carton transport conveyor 58. Selector device 53 may be that type of selector device provided as a part of the family of packaging machines known as the Quick Flex packaging machines manufactured by Riverwood International, Inc., as more fully disclosed in U.S. Pat. No. 5,546,734, issued on Aug. 20, 1996. Selector device 53 thus includes an endless conveyor belt 55 having a spaced series of selector wedges 57 positioned thereon used for forming the articles (not illustrated) into pre-formed groups of articles, and moving the articles laterally across the surface of conveyor belt 55 toward open end 41 of carton 40, and sliding the articles from the horizontal surface of conveyor belt 55 onto the horizontal bottom panel 42 of carton 40.

As shown in FIG. 7, through the use of roller hold down device 25, no lip or step up is present between the bottom panel 42 and conveyor belt 55 as the hold down device 25, and in particular roller 61 thereof, are shown holding bottom panel 43 of the carton firmly against carton flap score rail 31 so that bottom panel 42 is held taught on wear strips 47. Were a lip or step-up to occur, this would occur at the junction of the hinged connection point of bottom flap 43 to bottom panel 42, this situation arising, as described above, when carton 40 is allowed to twist or otherwise move within flight 39 of carton transport conveyor 27 (FIG. 3). Carton transport conveyor 58 of FIG. 7 differs from that of FIG. 7 in that it uses a pair of conveyor chains **59*a*, 59*b*** to form split pockets, i.e. it has adjustable flight widths, as more fully disclosed in U.S. Pat. No. 5,546,734, referenced hereinabove.

Still referring to FIG. 7, this embodiment of roller hold down device 25 once again has an aligned and spaced series of rollers 61, the lead one of which is illustrated in FIG. 7, which view looks downstream along and in the direction of the path of travel, the rollers extending along a common longitudinal axis angled approximately 5° downwardly in the direction of the path of travel, as shown more generally in FIGS. 3–6. Each of rollers 61 is rotatably supported on an elongate roller support bar 65, the support bar having a pair of spaced rods 76 extending therefrom, one of which is illustrated in FIG. 7, each one of rods 76 having a threaded end 77 passed through separate smooth bore 78 defined in mounting block 67. A threaded nut 80 is received on each one of threaded ends 77, on the outside, i.e. the side facing away from, roller support bar 65. A compression spring 81 is passed over that portion of rods 76 intermediate roller support bar 65 and mounting block 67. Nuts 80 are tightened to compress springs 81, the springs being held within a spring housings 82 if so desired, so that roller support bar 65, and rollers 61, are spring loaded in the compression direction as the roller support bar is urged away from mounting block 67 and toward carton flap score rail 31. Mounting block 67 is mounted on base plate 49 for lateral movement toward and away from carton flap score rails 31, and secured thereto, so that each of rollers 61 is yieldably engaged with the exterior of carton flap score rail 31 to hold, and pull, bottom flap 43 downward and against the carton flap score rail with a relatively constant force as carton 40 advances along the path of travel to thus ensure that bottom panel 42 remains flat on carton transport conveyor 58 to permit the smooth and uninterrupted transfer of articles (not illustrated) from article selector device 53 through open end 41 and into respective ones of cartons 40 moving along the path of travel.

Although not shown specifically herein, it is anticipated that base plate 49 illustrated in FIGS. 3 and 7, could be moved toward and away from carton flap score rail 31, if so desired, by a pneumatic actuator, or an electric actuator, used to move the entire spaced series of roller hold down devices 25 with respect to carton flap score rail 31, rather than individually adjusting each one of the roller hold down devices as desired. However, the advantage of this construction of roller hold down device 25 of this invention is that individual roller hold down devices can be withdrawn from engagement with carton flap score rail 31 when and if so desired, and the degree of compression of each one of roller hold down devices 25 against carton flap score rail 31 may be individually adjusted, as desired. For example, it may be desirable to have those roller hold down devices 25 extending along carton transport conveyors 27, 58, respectively, having a greater compression force as rollers 61 first hold bottom flaps 43 against carton flap score rail 31 when articles are first transferred from article selector device 53 (FIG. 7) into cartons 40, and then allowing the degree of compression of each roller hold down device 25 against the carton flap score rail to sequentially decrease as the carton becomes weighted with articles, thus ensuring that it remains seated on dead plate 48 and wear strips 47 of the carton transport conveyor once the problem of lipping or step up with an empty carton is no longer present. Another feature of the construction of roller hold devices 25 as illustrated in FIGS. 3–7 is the roller hold down device 25 is much simpler, and thus less expensive to fabricate and easier to use than the handle guide device 5 shown in FIGS. 1 and 2.

Referring to FIGS. 1 and 2, and as discussed hereinabove, each of aluminum housings 10 of handle guide device 5 has to be machined to receive rollers 9 therein, the rollers then being positioned about pin shafts 14, each pin shaft being angled 5° from horizontal, the pin shafts being received within the housings, and in the respective bottom plate 11 and top plate 12 of each handle guide device 5, then the housings, bottom plate, top plate, being fastened to mounting bar 7. This is a time consuming and expensive construction, which does not allow that degree of flexibility in operation permitted by the use of roller hold down devices 25 illustrated in FIGS. 3–7. Also, by constructing roller hold down devices 25 as shown in FIGS. 5 and 6, and more generally in FIGS. 3 and 7, each of rollers 61 is aligned a common longitudinal axis A so that the inclination of the rollers can be controlled together, thus ensuring more consistent control of the inclination of the rollers with respect to the carton transport conveyor than is available with handle guide device 5, in which the mounting of each one of rollers 9 within housings 10, and between bottom plate 11 and top plate 12, may result in different angles of inclination with respect to one another, it being difficult to otherwise ensure each one of rollers 9 has the precise same degree of inclination. Thus, and as apparent from the construction of roller hold down device 25, a simple yet highly efficient carton flap roller hold down device is disclosed for use on continuous motion packaging machines adapted for use with a wide variety of open-ended sleeve-type cartons is taught which provides an advance in the art heretofore unknown in its degree of simplicity, elegance of operation, and reliability.

While preferred embodiments of the invention have been disclosed in the foregoing specification, it is understood by those skilled in the art that variations and modifications thereof can be made without departing from the spirit and scope of the invention, as set forth in the following claims. In addition, the corresponding structures, materials, acts, and equivalents of all means or step plus function elements in the claims below are intended to include any structure, material, or acts for performing the functions in combination with other claimed elements, as specifically claimed herein.

I claim:

1. A carton flap hold down apparatus for use in seating a carton on a carton transport conveyor as the carton is moved thereon along a path of travel by holding the bottom flap of the carton against a carton flap score rail, the carton transport conveyor having a framework supporting the carton flap score rail and including a guide for folding the bottom flap of the carton into position against the carton flap score rail as the carton advances along the path of travel, said apparatus comprising:

a plurality of aligned carton flap hold down rollers disposed along a common longitudinal axis and extending in the direction of the path of travel for being engaged on the carton flap score rail, each said support roller being supported for rotation on an elongate roller support bar;

a mounting block for being fastened to the framework of the carton transport conveyor with respect to the carton flap score rail, said mounting block being spaced from said roller support bar; and an elongate intermediate member fastened at one end to said mounting block and fastened at the other of its ends to said roller support bar;

wherein the longitudinal axis of said hold down rollers is inclined toward said mounting block.

2. The apparatus of claim 1, wherein said longitudinal axis is inclined toward said mounting block in the direction of the path of travel along the carton transport conveyor.

3. The apparatus of claim 2, wherein said longitudinal axis is inclined toward said mounting block at an angle of five degrees.

4. The apparatus of claim 1, wherein said intermediate member comprises a spring assembly for urging said roller support bar toward the carton flap score rail so that each said roller is yieldably engaged on the carton flap score rail for slidably holding the bottom flap the carton thereon as the carton advances along the path of travel.

5. The apparatus of claim 1, wherein said intermediate member comprises a compression spring assembly.

6. The apparatus of claim 5, said compression spring assembly comprising:

a spaced pair of generally parallel rods fastened at one of their ends to said roller support bar, the other end of each respective one of said rods being threaded and passed through one of a spaced pair of smooth bores defined in said mounting block;

a pair of threaded nuts, one each of said nuts being threaded onto the threaded end of each respective one of said rods passed through said mounting block, said nuts bearing against said mounting block for controlling the compression of said spring assembly; and a compression spring passed over each said rod intermediate said mounting block and said roller support bar for urging said roller support bar away from said mounting block.

7. The apparatus of claim 1, wherein said intermediate member comprises a leaf spring assembly.

8. The apparatus of claim 7, said leaf spring assembly comprising:

at least one pair of spaced and parallel elongate leaf springs; and a spacer bar positioned intermediate said at least one pair of leaf springs at one of the ends of each said leaf spring, each said leaf spring being fastened to said spacer bar, said spacer bar being fastened to said mounting block;

wherein said leaf springs of said at least one pair of leaf springs are spaced at the other of their ends by said roller support bar, said roller support bar being positioned intermediate said leaf springs, each said leaf spring being fastened to said roller support bar.

9. A carton flap hold down apparatus for use in seating a carton on a carton transport conveyor as the carton is moved thereon along a path of travel by holding the bottom flap of the carton against a carton flap score rail supported on a framework of the carton transport conveyor, the carton transport conveyor including a guide for folding the bottom flap of the carton against the carton flap score rail as the carton advances along the path of travel, said apparatus comprising:

a plurality of rotatable carton flap hold down rollers disposed along a common longitudinal axis extending in the direction of the path of travel, each said support roller being supported for rotation on an elongate roller support bar;

a mounting block for being fastened to the framework of the carton transport conveyor with respect to the carton flap score rail, said mounting block being spaced from said roller support bar; and an elongate intermediate member fastened at one end to said mounting block and fastened at the other of its ends to said roller support bar;

wherein said intermediate member comprises a spring assembly for urging said roller support bar toward the carton flap score rail so that each said roller is yieldably engaged on the carton flap score rail for slidably holding the bottom flap of the carton therebetween as the carton advances along the path of travel.

10. The apparatus of claim 9, wherein said longitudinal axis of said hold down rollers is inclined toward said mounting block in the direction of the path of travel along the carton transport conveyor.

11. A carton flap hold down assembly for seating the cartons of a spaced series of empty erected sleeve-type paperboard cartons being advanced along a path of travel on a carton transport conveyor, the carton transport conveyor having a framework, a first elongate carton flap score rail and a spaced parallel second elongate carton flap score rail supported on the framework, and including a first guide and a spaced second guide for moving the respective ones of the spaced pairs of bottom flaps of the cartons against the respective carton flap score rails, said apparatus comprising:

a first elongate base plate, said first base plate being supported on the framework of the carton transport conveyor with respect to the first carton flap score rail;

a first spaced series of carton flap hold down roller devices supported on said base plate and extending along the path of travel for being positioned adjacent the first carton flap score rail;

each said carton flap hold down roller device including:

an elongate roller support bar;

a spaced series of aligned and rotatable carton flap hold down rollers disposed along a common longitudinal axis on said roller support bar for being engaged with the first carton flap score rail;

a mounting block fastened to said base plate, said mounting block being spaced from said roller support bar; and an elongate intermediate member fastened at one end to said mounting block and fastened at the other of its ends to said roller support bar;

wherein the longitudinal axis of said hold down rollers is inclined toward said mounting block in the direction of the path of travel.

12. The carton flap hold down assembly of claim 11, wherein said intermediate member of each said carton flap hold down roller device of said first series is constructed and arranged to urge the roller support bars thereof toward the first carton flap score rail so that each of said rollers is yieldably engaged on the first carton flap score rail for slidably holding the bottom flaps of the cartons therebetween as the cartons advance along the path of travel.

13. The carton flap hold down assembly of claim 11, wherein said mounting block of each said hold down roller device of said first series is transversely movable on said first base plate with respect to the length thereof.

14. The carton flap hold down assembly of claim 11, further comprising:

a second elongate base plate, said second base plate being supported on the framework of the carton transport conveyor with respect to the second carton flap score rail; and a second spaced series of said carton flap hold down roller devices supported on said second base plate and extending along the path of travel for being positioned adjacent the second carton flap score rail of the carton transport conveyor.

15. The carton flap hold down assembly of claim 14, wherein said intermediate member of each said carton flap hold down roller device of said second series is constructed and arranged to urge the roller support bars thereof toward the second carton flap score rail so that each of said rollers is yieldably engaged on the second carton flap score rail for slidably holding the bottom flaps of the cartons therebetween as the cartons advance along the path of travel.

16. The carton flap hold down assembly of claim 14, wherein said mounting block of each said hold down roller device of said second series is transversely movable on said second base plate with respect to the length thereof.

17. A carton flap hold down apparatus for use in seating a carton on a carton transport conveyor as the carton is moved thereon along a path of travel by holding at least one bottom flap of the carton against a carton flap score rail supported on a framework of the carton transport conveyor, the carton transport conveyor including a guide for folding the at least one bottom flap of the carton into position against the carton flap score rail as the carton advances along the path of travel, said apparatus comprising:

a spaced series of rotatable carton flap hold down rollers disposed along a common longitudinal axis, each of said support rollers being supported for rotation on an elongate roller support bar;

means, mounted on the carton transport conveyor framework with respect to said carton flap score rail and disposed in engagement with said roller support bar, for urging said roller support bar toward the carton flap score rail so that said rollers are yieldably urged into engagement with the carton flap score rail for slidably holding the at least one bottom carton flap therebetween as the carton advances along the path of travel;

said spaced series of rollers being constructed and arranged to pull the at least one bottom flap of the carton down as the at least one bottom flap passes between said rollers and against the carton flap score rail for seating the carton on the carton transport conveyor.

18. The carton flap hold down apparatus of claim 17, wherein said longitudinal axis of said rollers is inclined downwardly with respect to the carton flap score rail in the direction of the path of travel.

19. The carton flap hold down apparatus of claim 18, wherein the longitudinal axis of said rollers is inclined at an angle of approximately five degrees.

20. The carton flap hold down apparatus of claim 17, wherein said means for urging said roller support bar toward the carton flap score rail comprises a spring assembly.

21. The carton flap hold down apparatus of claim 20, wherein said spring assembly comprises a compression spring assembly.

22. The carton flap hold down apparatus of claim 20, wherein said spring assembly comprises a leaf spring assembly.

23. A carton transport conveyor for conveying a spaced series of empty erect sleeve-type paperboard cartons along a path of travel through a packaging machine, each carton having at least one bottom flap hingedly connected thereto, said carton transport conveyor comprising:

a framework;

an elongate carton flap score rail supported on said framework and extending along the path of travel, said score rail being constructed and arranged to at least partially support the cartons thereon as the cartons advance along the path of travel;

a guide positioned with respect to said carton flap score rail for folding the bottom flaps of the cartons adjacent said carton flap score rail as the cartons move along the path of travel;

an elongate base plate, said base plate being supported on said framework with respect to said carton flap score rail;

at least one carton flap hold down device supported on said base plate adjacent said carton flap score rail, said device comprising:

a plurality of aligned carton flap hold down rollers disposed along a common longitudinal axis extending in the direction of the path of travel, each said support roller being supported for rotation on an elongate roller support bar;

a mounting block fastened to the framework of the carton transport conveyor, said mounting block being spaced from said roller support bar; and an elongate intermediate member fastened at one end to said mounting block and fastened at the other of its ends to said roller support bar;

wherein the longitudinal axis of said hold down rollers is inclined toward said mounting block in the direction of the path of travel at an angle of approximately five degrees.

24. The carton transport conveyor of claim 23, wherein said intermediate member of said at least one carton flap hold down device is constructed and arranged to urge the roller support bar thereof toward the carton flap score rail so that each of said rollers is yieldably engaged on the carton flap score rail for slidably holding the at least one bottom flap of the cartons therebetween as the cartons advance along the path of travel.

25. The carton flap hold down assembly of claim 23, wherein said mounting block of said at least one hold down device is transversely movable on said base plate toward and away from said carton flap score rail.

26. The carton flap hold down assembly of claim 23, further comprising a spaced series of said at least one hold down device mounted on said base plate and extending in the direction of the path of travel along at least a portion of the length of said carton flap score rail.

* * * * *